US009410675B1

(12) United States Patent
McDermott et al.

(10) Patent No.: US 9,410,675 B1
(45) **Date of Patent: *Aug. 9, 2016**

(54) ELONGATED BEAM LIGHT EMITTING DIODE LIGHTING DEVICE

(71) Applicants: Kevin McDermott, Rockledge, FL (US); Loren W. Hausman, Palm Bay, FL (US)

(72) Inventors: Kevin McDermott, Rockledge, FL (US); Loren W. Hausman, Palm Bay, FL (US)

(73) Assignee: Kevin McDermott, Rockledge, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/660,436

(22) Filed: Mar. 17, 2015

(51) Int. Cl.

| | |
|---|---|
| ***F21V 7/04*** | (2006.01) |
| ***F21V 13/04*** | (2006.01) |
| ***F21V 5/00*** | (2015.01) |
| ***F21V 5/04*** | (2006.01) |
| ***F21V 7/00*** | (2006.01) |
| ***F21V 7/05*** | (2006.01) |
| *F21Y 103/00* | (2016.01) |
| *F21Y 105/00* | (2016.01) |
| *F21Y 101/02* | (2006.01) |

(52) U.S. Cl.
CPC ..... *F21V 13/04* (2013.01); *F21V 5/007* (2013.01); *F21V 5/008* (2013.01); *F21V 5/048* (2013.01); *F21V 7/0066* (2013.01); *F21V 7/0091* (2013.01); *F21V 7/05* (2013.01); *F21Y 2101/02* (2013.01); *F21Y 2103/003* (2013.01); *F21Y 2105/001* (2013.01)

(58) Field of Classification Search
CPC ..... F21V 13/04; F21V 5/048; F21V 5/007; F21V 5/008; F21V 7/05; F21V 7/0066; F21V 7/0091; F21Y 2101/02; F21Y 2103/003; F21Y 2105/001
See application file for complete search history.

(56) References Cited

U.S. PATENT DOCUMENTS

| | | | | |
|---|---|---|---|---|
| 2,356,654 | A * | 8/1944 | Cullman | F21V 5/04 200/84 C |
| 6,547,423 | B2 * | 4/2003 | Marshall | F21V 5/04 257/E33.072 |
| 6,632,004 | B2 * | 10/2003 | Sugawara | G03B 15/05 362/18 |
| 7,401,948 | B2 * | 7/2008 | Chinniah | F21V 5/04 362/310 |
| 7,918,583 | B2 * | 4/2011 | Chakmakjian | F21V 5/007 362/237 |
| 8,337,054 | B2 * | 12/2012 | Bernard | F21V 5/04 362/335 |

* cited by examiner

*Primary Examiner* — Alan Cariaso
(74) *Attorney, Agent, or Firm* — Hauptman Ham, LLP

(57) ABSTRACT

A lighting device includes one or more lighting assemblies, each having a light emitting diode (LED) emitting a light and a lens. Each lens has an impinging light surface refracting a first segment of the light to emerge from an exterior surface of the lens and a second segment of the light intersecting a side mirror whereat it is reflected to emerge from the lens. The lens collecting a large portion of the light emitted by the LED projects an evenly illuminating elongated light beam and appears evenly illuminating when viewed from an exterior location.

34 Claims, 5 Drawing Sheets

50

L1

L1A1

L1A2

ELONGATED BEAM LIGHT EMITTING DIODE LIGHTING DEVICE

BACKGROUND

Light emitting diode (LED) lighting devices are replacing incandescent lamp lighting devices in many applications including flashlights, automotive tail lamps, buoy lights, etc. LED light sources or lamps offer high efficiency; however, when employed in a lighting device, the efficacy of the lighting device depends upon the beam pattern of the lighting device relative to the requirements for the beam pattern of the emerging light.

The light emitted from an individual LED lamp can have a number of patterns depending upon the construction of the LED lamp. However, it is common for the light to be distributed within a hemisphere about an axis.

It is common for a lighting device to require an emerging light pattern different from the emitted light pattern from the LED lamp and therefore an optic or lens is necessary to redirect the light and modify the emitted light pattern from the LED lamp to match the required emerging light pattern for the lighting device.

In addition to matching the requirement for a particular emerging light pattern from the lighting device in order to maximize the efficacy of the lighting device, the lens should be designed to maximize the percentage of light emitted from the LED lamp which adds to the emerging light pattern from the lighting device.

In addition to having a required emerging light pattern, some lighting devices may also require that they appear evenly illuminating when viewed from outside the lighting device. In order to comply with that requirement, the lens should be designed such that the surface of the lighting device appears evenly illuminating.

Some lighting devices may also have size limitations and need to comply with a requirement that the lens be designed to minimize its size.

Some lighting devices may also require high-intensity emerging light beam patterns requiring a plurality of LEDs. For these devices, the lens must be designed such that a plurality of lenses can be assembled within the size limitations of the lighting device with each lens directing its emitted light into a common beam.

Some lighting devices may also be required to emit a light beam which is elongated beyond an angular beamwidth of eighty degrees.

Some lighting devices may also require a smooth and/or flat exterior surface permitting easy cleaning.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
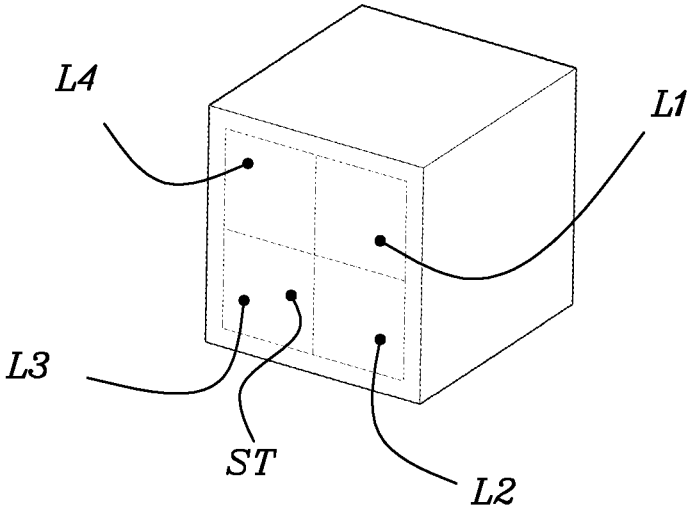
FIG. 1 is a perspective view of a lighting device according to some embodiments.

The following disclosure provides many different embodiments, or examples, for implementing different features of one or more embodiments the present disclosure. Specific examples of components and arrangements are described below to simplify the present disclosure. These are, of course, examples and are not intended to be limiting. The present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a perspective view of a composite lighting device 50 which is a combination of four individual lighting assemblies L1, L2, L3 and L4. Alternatively, composite lighting device 50 has more or less individual lighting assemblies depending upon the intensity of the emerging light beam required for lighting device 50, in at least some embodiments. Lighting assemblies L1, L2, L3 and L4, according to some embodiments, are identical or similar such that when assembled the lighting assemblies form smooth, flat and rectangular exterior light emerging Surface ST. The construction of lighting device 50 according to some embodiments is configured to achieve one or more of the following characteristics: an emerging light beam elongated beyond 80°, a smooth exterior surface, a flat exterior surface, a rectangular exterior surface, an optical design which maximizes the percentage of light emitted from the LED lamp which adds to the emerging light pattern required the lighting device, an exterior surface which appears to be evenly illuminating, a design which minimizes the size of the lighting device, a design permitting a plurality of lighting assemblies adequate for providing the intensity required of the lighting device and also within the size limitations of the lighting device.

Figure 2:
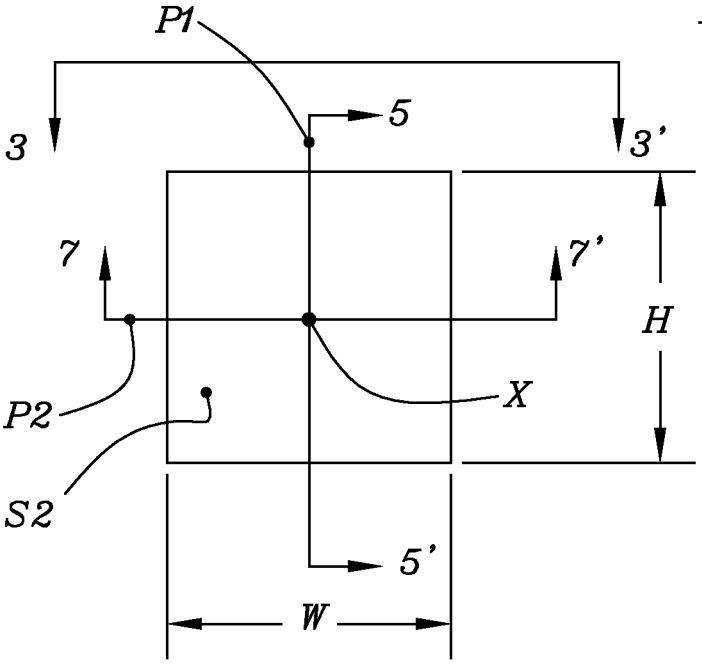
FIG. 2 is a view of lighting assembly L1 removed from FIG. 1 in some embodiments.

FIG. 2 is a front view of lighting assembly L1 removed from lighting device 50 of FIG. 1. Lighting assembly L1 according to some embodiments has a rectangular contour having a width W and height H such that it may be assembled with lighting assemblies L2, L3 and L4 to form lighting device 50 having a rectangular configuration. In some embodiments, lighting assemblies L1 L2, L3 and L4 have square light emerging surfaces resulting in lighting device 50 having a square light emerging surface. Lighting assemblies L1, L2, L3 and L4 according to some embodiments are similar or identical such that they easily fit together forming a continuous smooth and flat exterior emerging light surface ST of lighting device 50. Since, in some embodiments, each lighting assembly is designed to appear evenly illuminating and the lighting assemblies are configured to be assembled with minimal space between them, lighting device 50 also appears to be evenly illuminating. In some embodiments, exterior surface S2 is curved or has facets to direct the emerging light as required for specific uses of lighting device 50.

Figure 3:
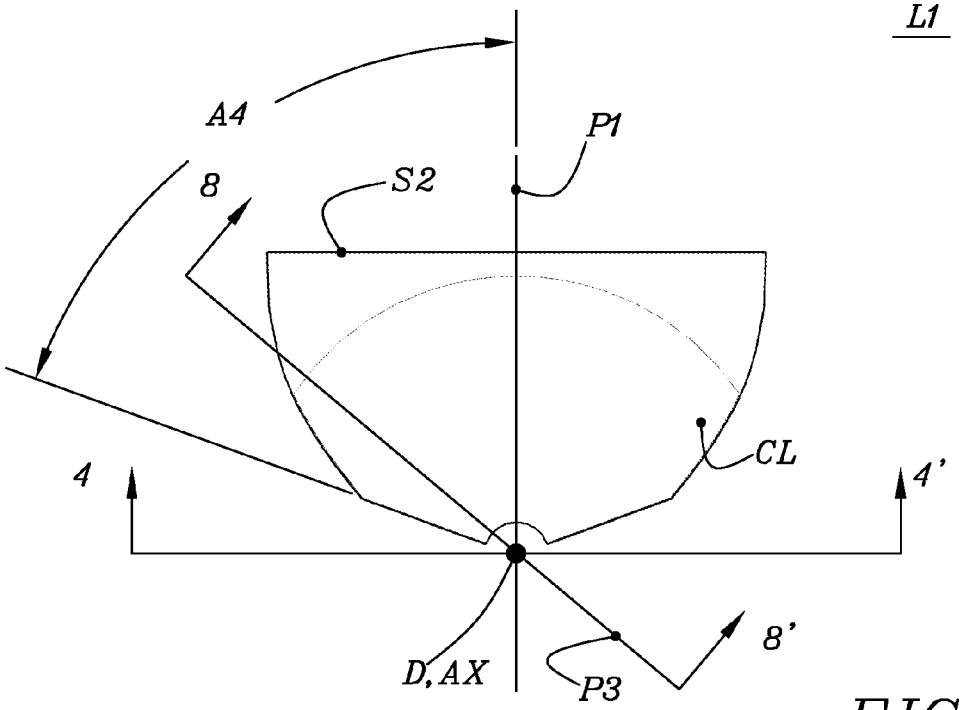
FIG. 3 is a view across 33' of FIG. 2 in some embodiments.

FIG. 3 is a top view of lighting assembly L1 taken across 33' of FIG. 2, according to some embodiments, showing light emitting diode (LED) Diode D and complex lens CL. Complex lens CL, according to some embodiments, is configured to collect light emitted from diode D within included angle A4. In some embodiments, angle A4 ranges from 60° to 80°. In some embodiments, angle A4 is 70°. In various embodiments, angle A4 varies depending on a number of features including the pattern of light emitted from the LED, efficacy required of lighting assembly L1, and limitations on the geometry of lighting device 50.

Figure 4:
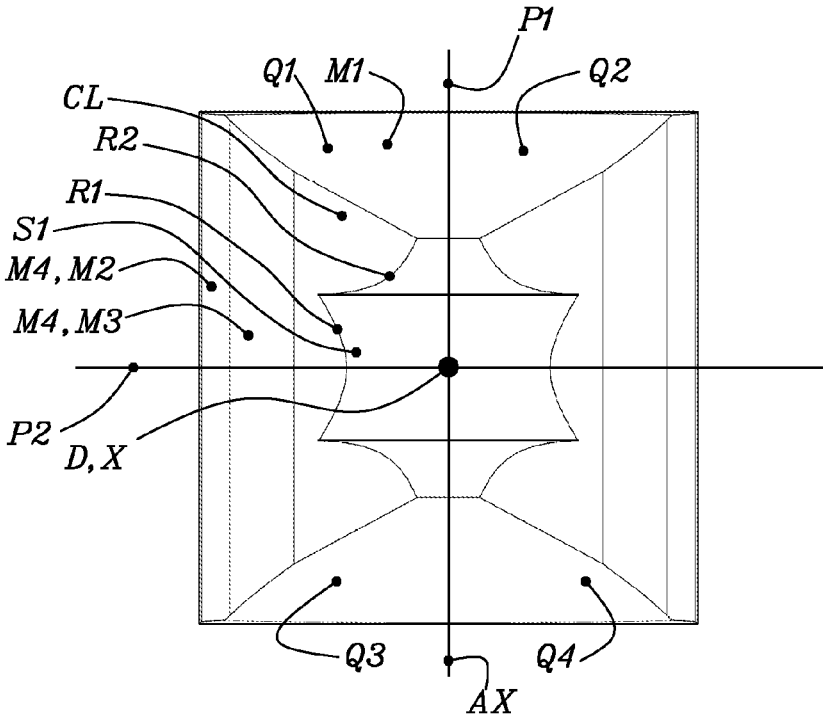
FIG. 4 is a view across 44' of FIG. 3 in some embodiments.

FIG. 4 is a view of lighting assembly L1 across 44' of FIG. 3, according to some embodiments, showing a view of complex lens CL comprising quadrants Q1, Q2, Q3 and Q4. lighting assembly L1, according to some embodiments, is symmetrical about plane P1 and plane P2. Therefore, according to some embodiments, the concepts and optical performance provided in the present disclosure for quadrant Q1 of the FIG. 4 view of lighting assembly L1, including complex lens CL, apply, due to symmetry, to the remaining three quadrants Q2, Q3 and Q4. In the present embodiment, plane P1 is a vertical plane and plane P2 is a horizontal plane that intersect at emitted light pattern axis X of the light emitted from diode D. In some embodiments, plane P1 may not be vertical and plane P2 may not be horizontal; however they remain orthogonal planes. In some embodiments diode D emits light within a hemisphere about axis X with most of the light emitted within 80° of axis X.

In some embodiments, complex lens CL includes first surface S1 which is a surface of revolution about revolution axis AX and comprises light condensing refracting surfaces R1 and R2. In some embodiments, first or impinging light surface S1 has a single refracting surface or any number of refracting surfaces in order to achieve additional control of the light emerging from complex lens CL. First surface S1 is the impinging light or interior surface whereat the light emitted from Diode D enters complex lens CL. Due to symmetry, surface S1 is in quadrants Q1, Q2, Q3 and Q4. In the present embodiment, surface S1 is a 140° surface of revolution about revolution axis AX, therefore intersecting light rays diverging from plane P1 by 70° in quadrants Q1 and Q3 and intersecting light rays diverging from plane P1 by 70° in quadrants Q2 and Q4. The angle of revolution A4 of surface S1 in the present environment is 140°, or twice the angle of revolution of surface S1 about axis X in quadrant Q1. The angle of revolution of surface S1, according to some embodiments, is different than 140°. In some embodiments, the angle of revolution ranges from 120° to 160°. In addition, according to some embodiments, the individual refracting surfaces which form surface S1 have distinct angles of revolution.

In some embodiments, complex lens CL also includes top mirror M1 which is a surface of revolution about revolution axis AX. In some embodiments, top mirror M1 is composed of a multiplicity of mirror segments comprising a multiplicity of contours in order to achieve a desired distribution of the light emerging from complex lens CL. In some embodiments, top mirror M1 is a 140° surface of revolution about revolution axis AX diverging from plane P1 by 70° in quadrant Q1 and diverging from plane P1 by 70° in quadrant Q2. Angle A4 represents the divergence of top mirror M1 about plane P1 quadrant Q1. In some embodiments, the angle of revolution of top mirror M1 is equal to the angle of revolution of surface S1. In some embodiments, the angle of revolution of top mirror M1 and the angle of revolution of surface S1 are not equal. In at least some embodiments the surface of revolution created by the 140° total angle of revolution of top mirror M1 would change from 140° in response to changes in the emerging light pattern of diode D or changes in the sizing or configuration of lighting assembly L1.

According to the present embodiment, complex lens CL also includes side mirror M4 which is comprised of mirrors M2 and M3, which are curved and perpendicular to plane P2. In various embodiments, mirror M4 is curved, flat or comprises segmented flat surfaces. In some embodiments, side mirror M4 is perpendicular to plane P2. In various embodiments, mirror M4 includes a single mirror or any number of mirrors in place of mirrors M2 and M3 to effect a desired distribution of the light emerging from complex lens CL. In some embodiments, mirrors, whether or not integral surfaces of complex lens CL, achieve reflectivity because their orientation relative to the rays of impinging light create total internal reflection. In some embodiments, complex lens CL is a solid lens molded of an optical plastic such as acrylic or polycarbonate.

Figure 5:
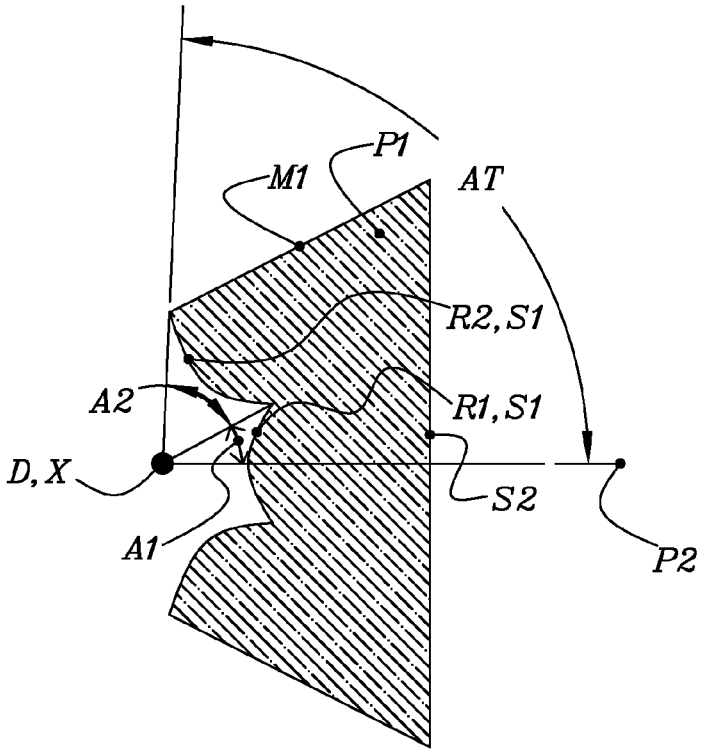
FIG. 5 is a cross-sectional view taken across 55' of FIG. 2 in some embodiments.

FIG. 5 is a cross-sectional view taken across 55' of FIG. 2, representing plane P1. FIG. 5 shows refracting surface R1 forming a 28 degree included angle A1 with diode D, in some embodiments. FIG. 5 additionally shows refracting surface R2 forming a 59 degree included angle A2 with diode D, in some embodiments. Included angle A1 and included angle A2 add up to form total angle AT which total 87 degrees, in some embodiments. Total angle AT represents, according to some embodiments, the light collected for quadrant Q1 of complex lens CL. Since LEDs may emit almost all of their light within 80° of the axis of their emitted light pattern, complex lens CL in quadrant Q1 is configured to collect most of the light emitted by diode D in quadrant Q1. Therefore, due to the symmetry of complex lens CL about planes P1 and P2, complex lens CL is configured to collect most of the light emitted by diode D. The angles disclosed in the present embodiment are changed for some embodiments in order for lighting device 50 to achieve specific requirements. In some embodiments, angle A1 has a range from 25° to 30°. In some embodiments, angle A2 has a range from 55° to 63°.

Figure 6:
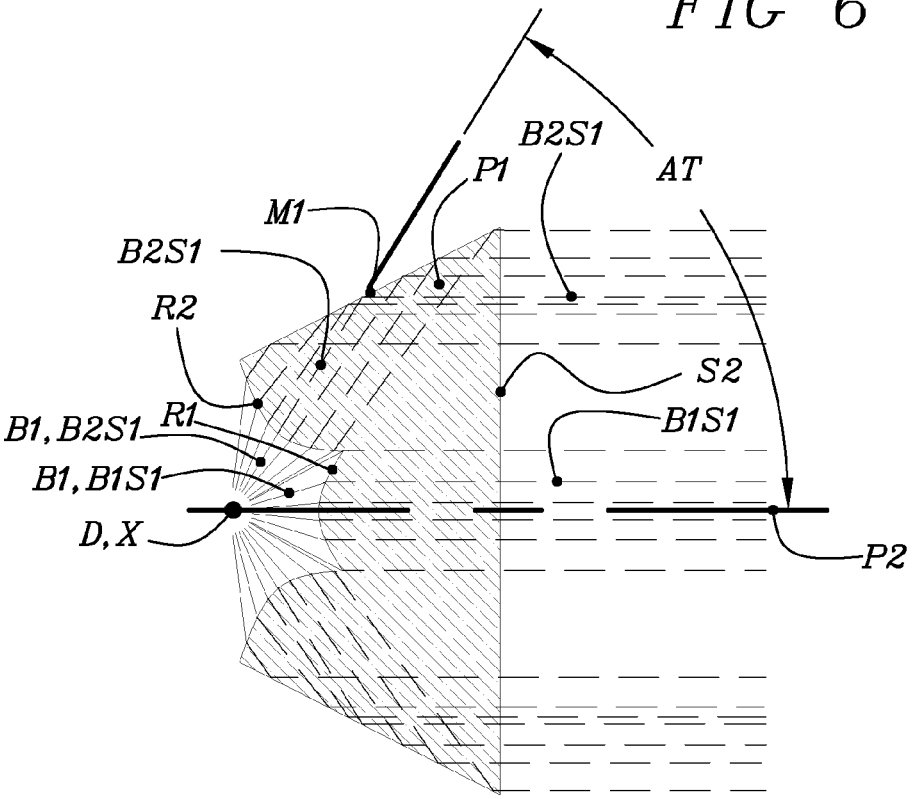
FIG. 6 is a FIG. 5 cross-sectional view with ray traces entering and leaving complex lens CL in some embodiments.

FIG. 6 is the FIG. 5 cross-sectional view with ray traces of light entering and leaving complex lens CL in plain P1 in quadrant Q1, according to some embodiments. For the present embodiment, the light emitted by diode D includes a first portion of light rays B1 and a second portion of light rays B2. The first portion of light rays B1, according to the present embodiment, includes all rays within angle A1, an angle of 28° about axis X. These are also the rays which intersect refractive surface R1. According to some embodiments, the first portion of light rays B1 includes alternate sizes of angle A1. The second portion of light rays B2, according to the present embodiment, includes all rays within angle A2 which is exterior to an angle of 28° about axis X and interior to an angle of 87° about axis X. These are also the rays which intersect refractive surface R2 and which—to be later described—are directed by refractive surface R2 towards a top mirror. According to some embodiments, the second portion of light rays B2 includes alternate sizes of angle A2.

FIG. 6 shows a first segment of the first portion of light rays B1S1 and a first segment of the second portion of light rays B2S1 emitted from diode D in quadrant Q1. Quadrants Q2, Q3 and Q4 have similar light rays emitted from diode D. FIG. 6 shows the first segment of the first portion of light rays B1S1 leaving diode D in a diverging pattern, intersecting surface R1, refracted towards parallelism with plane P2 and directed towards surface S2 and directed such that they pass through complex lens CL, emerging from complex lens CL at surface S2.

FIG. 6 also shows the first segment of the second portion of light rays B2S1 leaving diode D in a diverging pattern, intersecting surface R2, refracted towards parallelism towards top mirror M1. At top mirror M1 the first segment of the second portion of light rays B2S1 are reflected to remain parallel but directed towards parallelism with plane P2 and directed towards surface S2 such that they pass through complex lens CL, emerging from complex lens CL at surface S2.

The first segment of the first portion of light rays B1S1 and the first segment of the second portion of light rays B2S1 are not parallel after they are refracted by surfaces R1 and R2, respectively. However, top mirror M1 redirects the first segment of the second portion of light rays B2S1 such that they become parallel to plane P1 and therefore parallel to the first segment of the first portion of light rays B1S1. Therefore, the first segment of the first portion of light rays B1S1 and the first segment of the second portion of rays B2S1 in FIG. 6 pass through complex lens CL as parallel rays emerging from surface S1 as concentrated light. In some embodiments, refractive surface R1 and refractive surface R2 are contoured such that the refracted light is not parallel but diverging. This configuration results in a diverging beam spread of emerging light, which for some embodiments is desirable.

Figure 7:
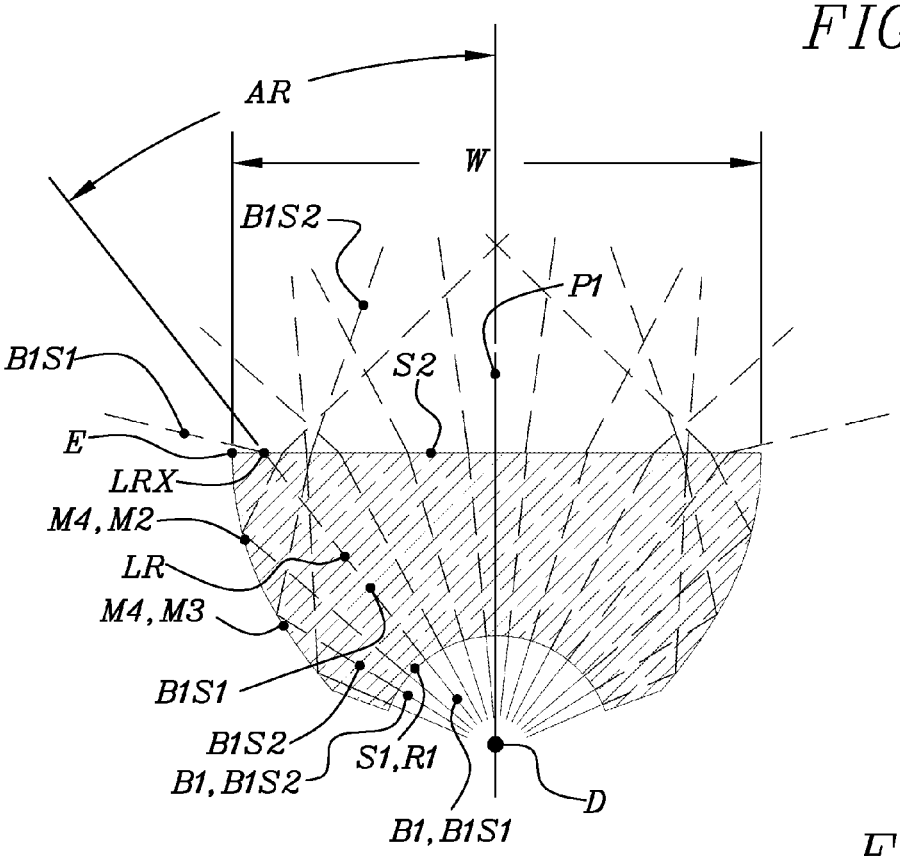
FIG. 7 is a cross-sectional view taken across 77' of FIG. 2 in some embodiments.

FIG. 7 is a cross-sectional view taken across 77' of FIG. 2 representing plane P2. In FIG. 6, the first segment of the first portion of light rays B1S1 in plane P1 appear to emerge from emerging light or exterior surface S2 without changing direction (without refraction). FIG. 7 shows additional light rays of the first segment of the first portion of rays B1S1 which are now in plane P2 rather than in plane P1. Looking at typical light ray LR which intersects surface S2 forming included angle AR, it can be seen that this ray and this group of rays forming the first segment of the first portion of light rays B1S1 in plane P2 rays do not intersect surface S2 perpendicularly but intersect surface S2 forming a variety of included angles of intersegment with surface S2. This configuration results in light rays emerging from surface S2 at a variety of angles relative to surface S2 with increased refraction for rays which intersect surface S2 with increased angular divergence from plane P1. This configuration effects spreading the first segment of the first portion of light rays B1S1 along plane P2 and perpendicular to plane P1.

It can be seen in FIG. 7 that light impinging upon surface S2 within a 40° angle of divergence from plane P1 is refracted and passes through surface S1. The light, however, does not pass directly through (without bending) surface S1 and does not remain within a 40° angle of divergence from plane P1. Upon refraction, some of the light is spread such that its angle of divergence from plane P1 approaches 90°. This configuration would appear to effect an emerging elongated light beam having a beam spread of almost 180°, considering that the beam spread is on both sides of plane P1. However, the emerging beam spread is far less than 180° because the amount of light being widely spread is minimal and is not adequate to intensify the beam at wide angles such that the beam would be considered as extending to 180°. This configuration uses side mirrors to reflect light that would be totally internally reflected such that it intersects surface S1 and is refracted to add additional light to the elongated beam. This additional light added to the beam increases the fringe intensity and therefore the beamwidth of the elongated beam. Spreading the light along plane P2 effects this light contributing to a light beam elongated along plane P2 and also abets making surface S2 appear evenly illuminating. Having surface S2 appear evenly illuminating achieves an objective which may be required of lighting device 50.

Looking again at FIG. 7, light ray LR intersects surface S2 and also forms included angle AR with plane P1. Based upon simple geometry it can be seen that angle AR is equal to the included angle between light ray LR and a normal to surface S2—not shown—at point of intersection LRX of light ray LR and surface S2. Hence, included angle AR is equal to the angle of incidence—relating to light ray LR and surface S2. In some embodiments, complex lens CL is constructed of polycarbonate plastic and has a critical angle of approximately 40°. In some embodiments, complex lens CL has a critical angle having a range of 35° to 45°. Angle AR of FIG. 7 is approximately 38° and therefore light ray LR is refracted and exits complex lens CL at surface S2. However, adjacent light rays forming included angles with plane P1 exceeding the critical angle do not exit from surface S2 and do not contribute to the emerging light beam because, due to total internal reflection, these rays are reflected back into complex lens CL.

In the present embodiment, light rays which emerge from surface S1 directed to intersect surface S2 such that they pass through surface S2 (they do not intersect surface S2 such that they experience total internal reflection) represent the first segment of the first portion of light rays B1S1. Other light rays which emerge from surface S1 directed such that, if they intersected surface S2, would be substantially reflected back into surface S2, represent the second segment of the first portion of light rays B1S2, which may have angles of divergence about plane P1 of at least the critical angle of complex lens CL.

In the present embodiment, side mirror M4 is configured within complex lens CL such that it intersects the second segment of the first portion of light rays B1S2 at an angle which employs total internal reflection at side mirror M4 to redirect these rays to intersect surface S2 at an angle such that they are refracted and pass through surface S2 to contribute to the emerging elongated light beam. Side mirror M4 therefore intersects light rays which would otherwise be trapped within complex lens CL due to total internal reflection at surface S2. Side mirror M4 subsequently reflects the second segment of the first portion of light rays B1S2 and directs them such that they intersect surface S2 at angles of incidence permitting them to emerge from surface S2. Finally, the rays may intersect and emerge from surface S2 at a variety of angles. This results in light rays emerging from surface S2 at a variety of angles relative to surface S2 with increased refraction for rays which intersect surface S2 at increased angular divergence from plane P1. This effects spreading the second segment of the first portion of light rays B1S2 along plane P2 and perpendicular to plane P1. Spreading the second segment of the first portion of light rays B1S2 along plane P2 at a variety of angles adds to the elongated beam created by the first segment of the first portion of light rays B1S1. Adding light beyond the critical angle divergence from plane P1 increases the intensity beyond the critical angle and therefore extends the acceptable intensity of the elongated beam beyond the critical angle. Spreading the light along plane P2 adds to the light beam elongated along plane P2 and also abets making surface S2 appear evenly illuminating. Having surface S2 appear as evenly illuminating achieves an objective which may be required of lighting device 50.

In some embodiments side mirror M4 additionally reflects light towards intersecting plane P1 such that, if extended, it would intersect plane P1. This adjustment in the design allows a reduction of the width of lighting assembly L1 and therefore the width of lighting device 50. Minimizing the size of lighting device 50 beneficially makes it more compact. In addition, by reducing the exterior surface ST, it makes the exterior surface appear more evenly illuminating.

Hence, both the first segment of the first portion of light rays B1S1 and the second segment of the first portion of light rays B1S2 contribute to an emerging light beam elongated along plane P2 and both abet making surface S2 appear evenly illuminating. The fact that surface S2 is rectangular and evenly illuminating, combined with the fact that similar lighting devices L2, L3 and L4 are assembled to create surface ST of lighting device 50, results in lighting device 50 having a surface capable of appearing to be evenly illuminating.

As previously indicated, side mirror M4 includes mirrors M2 and M3, and these mirrors can be adjusted to direct their reflected light at a variety of angles and still be in a position to effect total internal reflection. By adjusting these mirrors to direct the reflected light to converge towards plane P1, the present embodiment reduces the width W of complex lens CL, thereby achieving, according to some embodiments, an objective of minimizing size which may be required of lighting device 50.

Looking again at FIG. 7, it can be seen that, according to some embodiments, both the first segment of the first portion of rays B1S1 and the second segment of the first portion of light rays B1S2 emerge from surface S2 immediately adjacent to edge E. This is beneficial in abetting lighting assemblies L1 through L4 being assembled to form lighting device 50 without dark zones between them and thereby providing an evenly illuminating face for complex lens CL, which may be an objective for lighting device 50. In addition, exterior surface S2 of lighting assembly L1 is flat and smooth such that, when a plurality of similar lighting assemblies such as lighting assemblies L2, L3 and L4 are assembled to form lighting device 50, it has a smooth flat surface which may be desirable for many applications.

Figure 8:
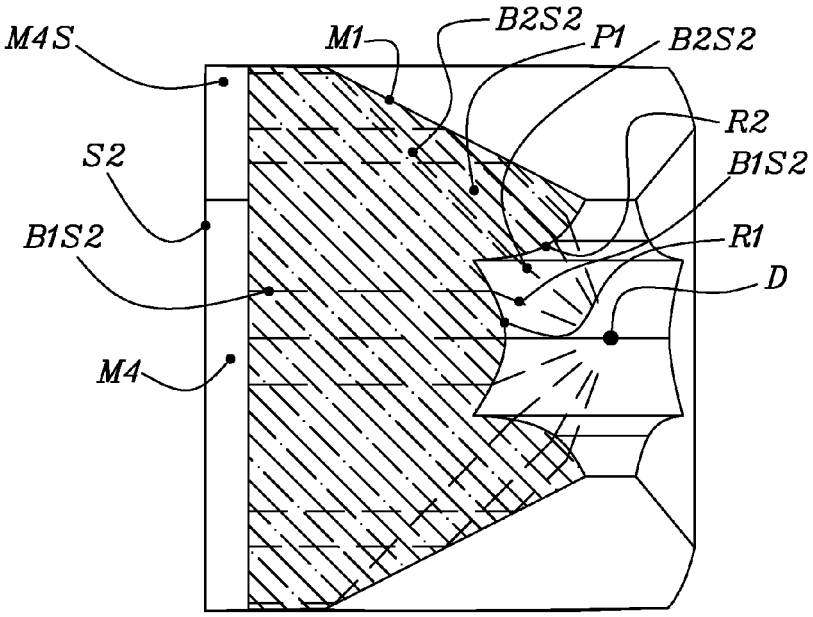
FIG. 8 is a cross-sectional view taken across 88' of FIG. 3 in some embodiments.

FIG. 8 is a cross-sectional view taken across 88' of FIG. 3 representing plane P3. In FIG. 8, the second segment of the first portion of light rays B1S2 are refracted at refractive surface R1 where they are brought towards parallelism and directed towards side mirror M4, whereat they are reflected towards surface S2 such that they may emerge from light assembly L1. FIG. 8 traces the rays up until side mirror M4, but does not trace the rays actually intersecting or reflecting from side mirror M4. However, according to some embodiments, side mirror M4 is perpendicular to plane P1; therefore since the light impinging on side mirror M4 is parallel to plane P1, side mirror M4 reflects the light without spreading it along plane P1. Nevertheless, the reflected light intersects surface S2 and is spread along plane P2, widening the emerging light beam, reducing dark spots within the light beam, and making the surface of complex lens CL appear more evenly illuminating, in some embodiments.

Also, in the embodiment of FIG. 8, the second segment of the second portion of light rays B2S2 are refracted at refractive surface R2 where they are brought towards parallelism and directed towards top mirror M1, whereat they are reflected towards second portion side mirror M4S. At side mirror M4S, they are reflected towards surface S2, intersecting surface S2 at an angle such that they pass through surface S2 to emerge from light assembly L1. According to some embodiments, second portion side mirror M4S is perpendicular to plane P2. Since the light impinging on second portion side mirror M4S is parallel to plane P1, according to some embodiments, second portion side mirror M4S reflects the light without spreading it along plane P1. However, as the reflected light intersects and is refracted at surface S2, it may be spread along plane P2, widening the emerging light beam, reducing dark spots within the light beam, and making the surface of complex lens CL appear more evenly illuminating, in some embodiments. In FIG. 8, according to some embodiments, second portion side mirror M4S is identical in contour to side mirror M4. According to some embodiments, second portion side mirror M4S is identical in contour and an extension of side mirror M4. In some embodiments, second portion side mirror M4S and side mirror M4 have different contours. Second portion side mirror M4S is configured to intersect and reflect the second segment of the second portion of light rays B2S2 before they intersect surface S2 and would otherwise be reflected back into complex lens CL and fail to contribute to the light beam emerging from complex lens CL.

Figure 9:
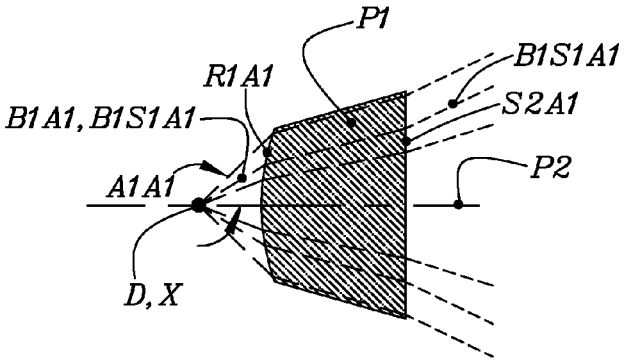
FIG. 9 is a cross-sectional view of alternate one lighting assembly L1A1 in some embodiments.
Figure 10:
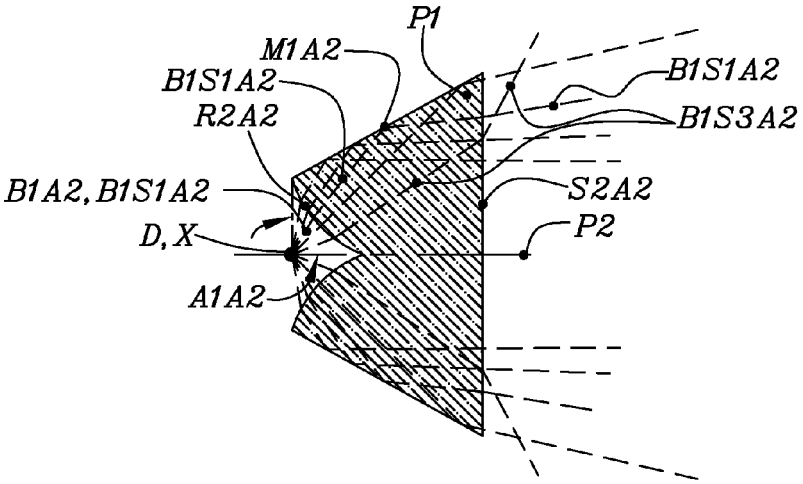
FIG. 10 is a cross-sectional view of alternate two lighting assembly L1A2 in some embodiments.

FIGS. 9 and 10 disclose alternate one lighting assembly L1A1 and alternate two lighting assembly L1A2, either of which may substitute for lighting assembly L1 of FIG. 7. According to some embodiments, the alternate lighting assemblies reduce the size and complexity of the optics for lighting device 50; however, the alternative lighting assemblies also reduce the percentage of light emitted from diode D which contributes to the emerging beam pattern. The alternate lighting assemblies provided in FIGS. 9 and 10 show refractive surfaces R1A1 and R2A2 concentrating the impinging light but not necessarily making it parallel. Configuring these surfaces to concentrate but not to parallelism has a first advantage in that they can collect more light. It also has a second advantage in that the light can be made to spread along plane P1 in addition to its being spread along plane P2. This configuration widens the emerging light beam. In addition, it makes the exterior surface of the lighting device appear evenly illuminating when viewed from angles diverging from plane P2. Although this concept of having refractive surfaces R1A1 and R2A2 or the equivalent light impinging surface S1 concentrating the impinging light but not necessarily making it parallel is shown only in FIGS. 9 and 10, all parts of the concept could be used in lighting device L1.

FIG. 9 is a cross-sectional view of alternate lighting assembly one UAL which replaces surface S1 of lighting assembly L1 of FIGS. 5 and 6 with alternate one impinging surface S1A1 comprising alternate one refractive surface R1A1, in some embodiments. Alternate one lighting assembly UAL according to some embodiments, collects only the alternate one first portion of light rays B1A1 of the light emitted from diode D. In FIG. 9, alternate one first portion of light rays B1A1 emitted from diode D within alternate one angle A1A1 about axis X intersect alternate one refractive surface R1A1, whereat they are refracted to become more concentrated about plane P2. Although more parallel, plane P2 the light rays may not be parallel to plane P2. Alternate one angle A1A1 of FIG. 9 can be substantially larger than angle A1 of FIG. 5 due to the difference in the required bending of the light rays. Since alternate one angle A1A1 may be larger than angle A1 of FIG. 5, alternate one refractive surface R1A1 collects a larger percentage of the light emitted from Diode D than surface R1 of FIG. 5. Therefore, alternate one angle A1A1 may, according to some embodiments, collect sufficient light such that an additional light reflective surface such as reflective surface R2 of FIG. 5, which refracts additional light towards a top mirror such as mirror M1 of FIG. 5, is not required.

In addition to bringing alternate one first portion of light rays B1A1 towards parallelism, alternate one reflective surface R1A1 directs a first segment of alternate one first portion of light rays B1S1A1 to intersect alternate one exterior surface S2A1. Alternate one reflective surface R1A1 additionally directs a second segment of alternate one first portion of light rays B1A1 to intersect a side mirror (not shown), whereat some or all of the light rays are reflected towards alternate one exterior surface S2A1. An additional cross-section similar to FIG. 7 relating to lighting assembly L1 is not shown for alternate lighting assembly L1A1 because it has functioning similar to that of FIG. 7. Specifically, it has a second segment of light rays (like the second segment of the first portion of light rays B1S2 of FIG. 7) intersecting a side mirror (like side mirror M1 of FIG. 7) and reflected towards alternate one exterior surface S2A1 (like surface S2 of FIG. 7).

FIG. 10 is a cross-sectional view of alternate two lighting assembly L1A2, which replaces surface S1 of lighting assembly L1 of FIGS. 5 and 6 with alternate two impinging surface S1A2 comprising alternate two refractive surface R2A2, in some embodiments. Alternate two lighting assembly L1A2, according to some embodiments, collects only the alternate two first portion of light rays B1A2 of the light emitted from diode D. In FIG. 10, the alternate two first portion of light rays B1A2 emitted from diode D within alternate two angle A1A2 about axis X intersect alternate two refractive surface R1A2, whereat they are refracted to become more concentrated and directed towards alternate two top mirror M1A2, whereat a first segment of the first portion of alternate two light rays B1S1A2 are reflected and directed to intersect and emerge from alternate two exterior surface S2A2 to add to the emerging light beam. Alternate two angle A1A2 of FIG. 11 can be substantially larger than angle A1 of FIG. 5 due to the difference in the required bending of the light rays. Since alternate two angle A1A2 may be larger than angle A1 of FIG. 5, alternate two refractive surface R2A2 may collect a larger percentage of the light emitted from Diode D than surface R1 of FIG. 5. Therefore, according to some embodiments, alternate two angle A1A2 may collect sufficient light such that an additional refractive surface such as refractive surface R1 of FIG. 5, which refracts light towards parallelism with plane P2, is not required.

Alternate two top mirror M1A2 additionally reflects and directs a second segment of the alternate two first portions of light rays B1A2 to intersect a side mirror which reflects and directs the rays towards alternate two exterior surface S2A2, in some embodiments. An additional cross-section, as provided in FIG. 8 of lighting assembly L1, is not shown for alternate two lighting assembly L1A2 because it would be similar to FIG. 8 showing a second segment of the first portion of alternate two light rays (like the second segment of the second portion of light rays B2S2 of FIG. 8) directed by a top mirror (like top mirror M1 of FIG. 8) towards a side mirror (like side mirror M4 of FIG. 8), whereat the rays are reflected towards alternate two exterior surface S2A2 (like exterior surface S2 of FIG. 8).

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed:

1. A lighting device comprising:

a lighting assembly comprising a light emitting diode (LED) coincident with an emitted light axis and configured to emit a light having a divergence about said emitted light axis, said lighting assembly having a first plane coincident with said emitted light axis, a second plane perpendicular to said first plane and coincident with said emitted light axis, a revolution axis coincident with said LED and perpendicular to said second plane, said lighting assembly comprising a lens of a transparent material disposed about said LED, said lens comprising an impinging light surface about said revolution axis and further comprising a side mirror, and said impinging light surface comprising a first refracting surface configured to intersect and refract the light within a first angle about said second plane, with a first segment of the light within a second angle about said first plane concentrated and directed towards an exterior surface of the lens for exiting said lighting assembly, and a second segment of the light exterior to said second angle about said first plane concentrated and directed towards said side mirror, whereat said side mirror is configured to reflect said second segment of said light towards the exterior surface for exiting said lighting assembly, whereby said first segment of said light and said second segment of said light are controlled to emerge from said lighting assembly in an elongated light beam.

2. The lighting device according to claim 1, wherein:

said lighting device comprises a plurality of said lighting assemblies configured so that said elongated light beam of each said lighting assembly is disposed to form a combined elongated light beam of said lighting device.

3. The lighting device according to claim 1, wherein:

said lighting device comprises a plurality of said lighting assemblies, with said exterior surface of each said lighting assembly substantially flat and disposed to form a substantially flat exterior surface of said lighting device.

4. The lighting device according to claim 1, wherein:

said lighting device comprises a plurality of said lighting assemblies, with said exterior surface of each said lighting assembly substantially smooth and disposed to form a substantially smooth exterior surface of said lighting device.

5. The lighting device according to claim 1, wherein:

said lighting device comprises a plurality of said lighting assemblies, with said exterior surface of each said lighting assembly substantially rectangular and disposed for effecting a substantially rectangular exterior surface of said lighting device.

6. The lighting device according to claim 1, wherein:

said side mirror is perpendicular to said second plane.

7. The lighting device according to claim 1, wherein:

said side mirror is curved and perpendicular to said second plane.

8. The lighting device according to claim 1, wherein:

said impinging light surface exceeds sixty degrees about said first plane.

9. The lighting device according to claim 1, wherein:

said side mirror is further configured to reflect said light towards intersecting said first plane.

10. The lighting device according to claim 1, wherein:

said first refracting surface is within an angle having a vertex at said LED and said angle is 28 degrees about said second plane.

11. A lighting device comprising:

a lighting assembly having a light emitting diode (LED) coincident with an emitted light axis and configured to emit a light having a divergence about said emitted light axis;

said lighting assembly having a first plane coincident with said emitted light axis, a second plane perpendicular to said first plane and coincident with said emitted light axis, a revolution axis coincident with said LED and perpendicular to said second plane, said lighting assembly comprising a lens of a transparent material disposed about said LED, said lens comprising an impinging light surface about said revolution axis and a top mirror about said revolution axis, said lens further comprising a side mirror, and said impinging light surface comprising a first refracting surface configured to intersect and refract the light towards said top mirror, said top mirror being configured to reflect the light, with a first segment of said light directed towards an exterior surface of the lens for exiting said lighting assembly and a second segment of said light directed towards said side mirror, whereat said side mirror is configured to reflect said second segment of said light towards the exterior surface for exiting said lighting assembly, whereby said first segment of said light and said second segment of said light are controlled to emerge from said lighting assembly in an elongated light beam.

12. The lighting device according to claim 11, wherein:

said lighting device comprises a plurality of said lighting assemblies configured so that said elongated light beam of each said lighting assembly is disposed to form a combined elongated light beam of said lighting device.

13. The lighting device according to claim 11, wherein:

said lighting device comprises a plurality of said lighting assemblies, with said exterior surface of each said lighting assembly substantially flat and disposed to form a substantially flat exterior surface of said lighting device.

14. The lighting device according to claim 11, wherein:

said lighting device comprises a plurality of said lighting assemblies, with said exterior surface of each said lighting assembly substantially smooth and disposed to form a substantially smooth exterior surface of said lighting device.

15. The lighting device according to claim 11, wherein:

said lighting device comprises a plurality of said lighting assemblies, with said exterior surface of each said lighting assembly substantially rectangular and disposed for effecting a substantially rectangular exterior surface of said lighting device.

16. The lighting device according to claim 11, wherein:

said side mirror is perpendicular to said second plane.

17. The lighting device according to claim 11, wherein:

said side mirror is curved and perpendicular to said second plane.

18. The lighting device according to claim 11, wherein:

said impinging light surface exceeds sixty degrees about said first plane.

19. The lighting device according to claim 11, wherein:

said side mirror is further configured to reflect said light towards intersecting said first plane.

20. The lighting device according to claim 11, wherein:

said lens comprises a transparent polycarbonate or an acrylic resin.

21. The lighting device according to claim 11, wherein:

said impinging light surface additionally directs the light towards parallelism.

22. A lighting device comprising:

a lighting assembly comprising a light emitting diode (LED) coincident with an emitted light axis and configured to emit a light having a divergence about said emitted light axis;

said lighting assembly having a first plane coincident with said emitted light axis, a second plane perpendicular to said first plane and coincident with said emitted light axis, a revolution axis coincident with said LED and perpendicular to said second plane, said lighting assembly comprising a lens of a transparent material disposed about said LED, said lens comprising an impinging light surface about said revolution axis and a top mirror about said revolution axis, said lens further comprising a side mirror, said impinging light surface comprising a first refracting surface configured to intersect and refract a first portion of the light within a first angle about said second plane, with a first segment of the light within a second angle about said first plane directed towards an exterior surface of the lens for exiting the lighting assembly, and a second segment of the light exterior to said second angle about said first plane directed towards said side mirror, whereat said side mirror is configured to reflect said second segment of said first portion towards the exterior surface for exiting said lighting assembly, whereby said first segment of said first portion and said second segment of said first portion are controlled to emerge from said lighting assembly, said impinging light surface further comprising a second refracting surface configured to intersect and refract a second portion of the light towards parallelism and towards said top mirror, said top mirror being configured to reflect the second portion, with a first segment of said second portion directed towards an exterior surface of the lens for exiting said lighting assembly and a second segment of said second portion directed towards said side mirror, whereat said side mirror is configured to reflect said second segment of said second portion towards the exterior surface for exiting said lighting assembly, and whereby said first segment and said second segment of said first portion of said light and said first segment and said second segment of said second portion of said light are controlled to emerge from said lighting assembly in an elongated light beam.

23. The lighting device according to claim 22, wherein:

said lighting device comprises a plurality of said lighting assemblies configured so that said elongated light beam of each said lighting assembly is disposed to form a combined elongated light beam of said lighting device.

24. The lighting device according to claim 22, wherein:

said lighting device comprises a plurality of said lighting assemblies, with said exterior surface of each said lighting assembly substantially flat and disposed to form a substantially flat exterior surface of said lighting device.

25. The lighting device according to claim 22, wherein:

said lighting device comprises a plurality of said lighting assemblies, with said exterior surface of each said lighting assembly substantially smooth and disposed to form a substantially smooth exterior surface of said lighting device.

26. The lighting device according to claim 22, wherein:

said lighting device comprises a plurality of said lighting assemblies, with said exterior surface of each said lighting assembly substantially rectangular and disposed for effecting a substantially rectangular exterior surface of said lighting device.

27. The lighting device according to claim 22, wherein:

said side mirror is perpendicular to said second plane.

28. The lighting device according to claim 22, wherein:

said side mirror is curved and perpendicular to said second plane.

29. The lighting device according to claim 22, wherein:

said impinging light surface exceeds sixty degrees about said first plane and said top mirror exceeds sixty degrees about said first plane.

30. The lighting device according to claim 22, wherein:

said side mirror is further configured to reflect said light towards intersecting said first plane.

31. The lighting device according to claim 22, wherein:

said lens comprises a transparent polycarbonate or acrylic resin.

32. The lighting device according to claim 22, wherein:

said impinging light surface is a surface of revolution about said revolution axis, said top mirror is a surface of revolution about said revolution axis, and said side mirror is perpendicular to said second plane.

33. A lighting device comprising:

a lighting assembly comprising a light emitting diode (LED) coincident with an emitted light axis and configured to emit a light having a divergence about said emitted light axis, said light is within an angle having a vertex at said LED and said angle is 28 degrees about a second plane, said lighting assembly having a first plane coincident with said emitted light axis, said second plane perpendicular to said first plane and coincident with said emitted light axis, a revolution axis coincident with said LED and perpendicular to said second plane, said lighting assembly comprising a lens of a transparent material disposed about said LED, said lens comprising an impinging light surface being a surface of revolution about said revolution axis and exceeding sixty degrees about said first plane, said lens further comprising a side mirror, said impinging light surface comprising a first refracting surface configured to intersect and refract the light within a first angle about said second plane, with a first segment of the light within a second angle about said first plane directed towards an exterior surface of the lens for exiting the lighting assembly and a second segment of the light exterior to said second angle about said first plane directed towards said side mirror, whereat said side mirror is configured to reflect said second segment of said light towards the exterior surface for exiting said lighting assembly, whereby said first segment of said light and said second segment of said light are controlled to emerge from said lighting assembly in an elongated light beam, said lighting device additionally comprising a plurality of said lighting assemblies, with said exterior surface of each said lighting assembly substantially flat and disposed to form a substantially flat exterior surface of said lighting device.

34. The lighting device according to claim 33, wherein:

said impinging light surface additionally directs the light towards parallelism.

* * * * *